United States Patent [19]

Bauer

[11] 4,239,216

[45] Dec. 16, 1980

[54] GOLFER'S GREENS KEEPING AID

[76] Inventor: Frank L. Bauer, 903 Valmont Ct., Wyomissing, Pa. 19610

[21] Appl. No.: 967,299

[22] Filed: Dec. 7, 1978

[51] Int. Cl.[3] ..... A63B 57/00

[52] U.S. Cl. ..... 273/32 B; 273/32 A; 273/162 D; 273/162 F; 224/918

[58] Field of Search ..... 273/162 R, 162 A, 162 B, 273/162 C, 162 D, 162 E, 162 F, 32 A, 32 B, 32 R; 224/918

[56] References Cited

U.S. PATENT DOCUMENTS

| | | | |
|---|---|---|---|
| 2,178,872 | 11/1939 | Engstrom | 273/32 A |
| 2,261,959 | 11/1941 | Buttikofer | 273/162 D |
| 3,456,737 | 7/1969 | Rhyme | 273/162 F X |
| 3,791,652 | 2/1974 | Schuler | 273/162 D |

*Primary Examiner*—George J. Marlo
*Attorney, Agent, or Firm*—Kyle W. Rost

[57] ABSTRACT

A casing having a lower portion engageable in the shaft of a golf club contains a tool for repairing dents in the green and a dispenser for ball marker tokens. The casing has an axial bore that receives the tool and carrier, and an annular groove surrounding the top of the bore is crossed by radially extending pins that mate with suitable clips on the dispenser to retain the tool and attached dispenser in the casing when not in use. The dispenser has either a depending skirt that mates with the groove and has rigid clips formed therein, or spring clips that enter the groove and resiliently engage the pins. In the former case, the bottom of the groove has a spring loaded disc that tensions the tool and carrier upwardly to cause the rigid clips to be retained on the pins by friction. The tokens in the dispenser have a recess in each top surface as an aid to removal from the dispenser and to provide a location to receive informational material.

7 Claims, 5 Drawing Figures

10
18
14

12
16

102
106
114
106
104

112
84
108
32
30
110
106
24
86
97
84
98
82
96
88
90
78
91
80
100
80
100
94
92
94
76
74
70
22
72
73
3
62
56
58
60
32
20
30
28
26
3

62
56
32
58
48
30
46
44
28
42
26
54
40
52
38
50
36

GOLFER'S GREENS KEEPING AID

BACKGROUND OF THE INVENTION

1. Field of the Invention

The invention relates to amusement devices and games, and more specifically to bats, mallets, rackets, cues, pins and billies. In particular, the game of golf, golfer's tools, and ball position markers are addressed. The invention discloses a tool for carrying ball markers and for repairing ball marks on the green, which tool is adapted to be incorporated into the putter.

2. Description of the Prior Art

The game of golf embodies a great number of customs and courtesies that are rigidly adhered to by the dedicated advocate. Many of the courtesies are designed to preserve the quality of the golf course for subsequent players, as it is well known that great maintenance is required to preserve the quality of the many acres that constitute a golf course. Other courtesies are designed to expedite play among members of a group.

The putting green is the most carefully maintained portion of the golf course, as on this surface the golfer executes carefully aimed and carefully stroked shots wherein the ball is in constant rolling contact with the putting green surface. Any unexpected irregularity on the green surface can disrupt an otherwise well executed shot. Golfers, therefore, expect that the green surface will be free of litter, gouges, and dents, and every player is expected to remedy any such irregularities that he has caused.

One common source of damage to the green is a ball mark, caused when a ball lands on the green at the termination of aerial flight from the fairway. One way of repairing a ball mark is to dig into the green with a small tool and "fluff" the dent created by the ball. If the player has a golf tee at hand, this may be employed to do the job. However, it is often the case that the player does not have a suitable tool at hand. As it is also the custom to leave the golf bag and cart at a distance from the green, again to preserve the smoothness of the surrounding turf, a player may leave his dent unrepaired for lack of suitable means to fluff the area.

Another common situation is that two or more players in a group will have their golf balls aligned along similar paths toward the hole on the putting green. The player furthest from the hole is required to putt first, for the reason that persons standing closer to the hole will, temporarily at least, disrupt the smoothness of the grass over which the further player's ball will travel. Accordingly, if a closer lying ball is in the path of the further ball, the closer ball is removed and marked with a flat marker such as a dime. This again creates a situation where the golfer must have a suitable marker at hand. Since many players are on a golf course at one time, each golfer is expected to play rapidly so that following groups will not be unduly delayed. Any deviation from the smooth play of the game can cause an undesirable delay. For this reason, it is quite important that the player have all necessary tools and markers immediately available to repair dents and mark ball locations without having to leave the putting green to obtain the necessary article from his golf bag or cart.

In the prior art, many persons have addressed the need for ball markers and have provided suitable carriers to enable these to be conveniently carried by the golfer. U.S. Pat. No. 3,233,802 to Ludwick provides a belt-mounted carrier for ball markers. U.S. Pat. Nos. 2,700,547 to Kraeling, 2,261,959 to Buttikofer, and 2,178,872 to Engstrom provide for ball marker carriers that may be placed on the golf club, preferrably the putter, so that the markers will be available when the putter is in hand. U.S. Pat. No. 880,419 teaches a construction for a shaft-mounted disc dispenser especially adapted to hold coins and to be mounted on an umbrella handle, and U.S. Pat. No. 2,567,332 teaches a general purpose coin holder. Both of the latter patents relate to spring loaded disc dispensers.

The invention relates to an advance in the type of carriers known in the art, and provides a novel combined tool that both dispenses ball markers and is adapted to repair ball dents in the green.

SUMMARY OF THE INVENTION

The golfer's aid provides a casing that is mountable on the top of a golf club shaft, and a tool contained within the casing and removeable therefrom with a downwardly extending shaft and a pointed lower end for repairing dents in the putting green. On the top of the tool is a token carrier operable with the tool contained or removed from the casing to dispense ball marker tokens, and to provide a handle grip for use of the tool. Each marker token is a disc with a recess in the top surface thereof for aiding in removal of the token from the carrier and for receiving inserts containing informational matter such as advertisements. The tool is retained in the casing by a depending skirt that mates with an annular groove surrounding the top of the casing, and the skirt has suitable clips formed thereof to hook over pins extending radially through the groove. The clips may be resilient enough to clamp onto the pins, or the casing may have a spring loaded pressure disc on the bottom of its bore that presses upwardly against the bottom of the tool to create friction between the pins and a substantially non-resilient hook or clip. In the latter case, the disc may have a recess on its top surface to be centrally engaged by the tip of the tool, and may also have a depending stub on the bottom of the disc to be engaged in the core of a spring underlying the disc, both the recess and the stub serving to maintain the positional stability of the disc when pressed by the tool end.

The primary object of the invention is to create an aid for use on the putting green that immediately provides all commonly required accessories for the golfer. Toward this end, the invention provides a casing that may be installed on the putter and carry both a dent repair tool and a ball position marker carrier, equipped with suitable position markers. Through the combination of these two accessories with the putter, it is assured that the required aid will not be forgotten. As a result, not only is delay of the game avoided, but ball dents will be readily repaired in situations where they might otherwise be ignored for immediate lack of a suitable repair tool. Therefore, it is anticipated that the invention will speed play on the putting greens and also will improve the quality of the game for following players.

DESCRIPTION OF THE PREFERRED EMBODIMENT

Figures 1, 2, 3, 4, 5:
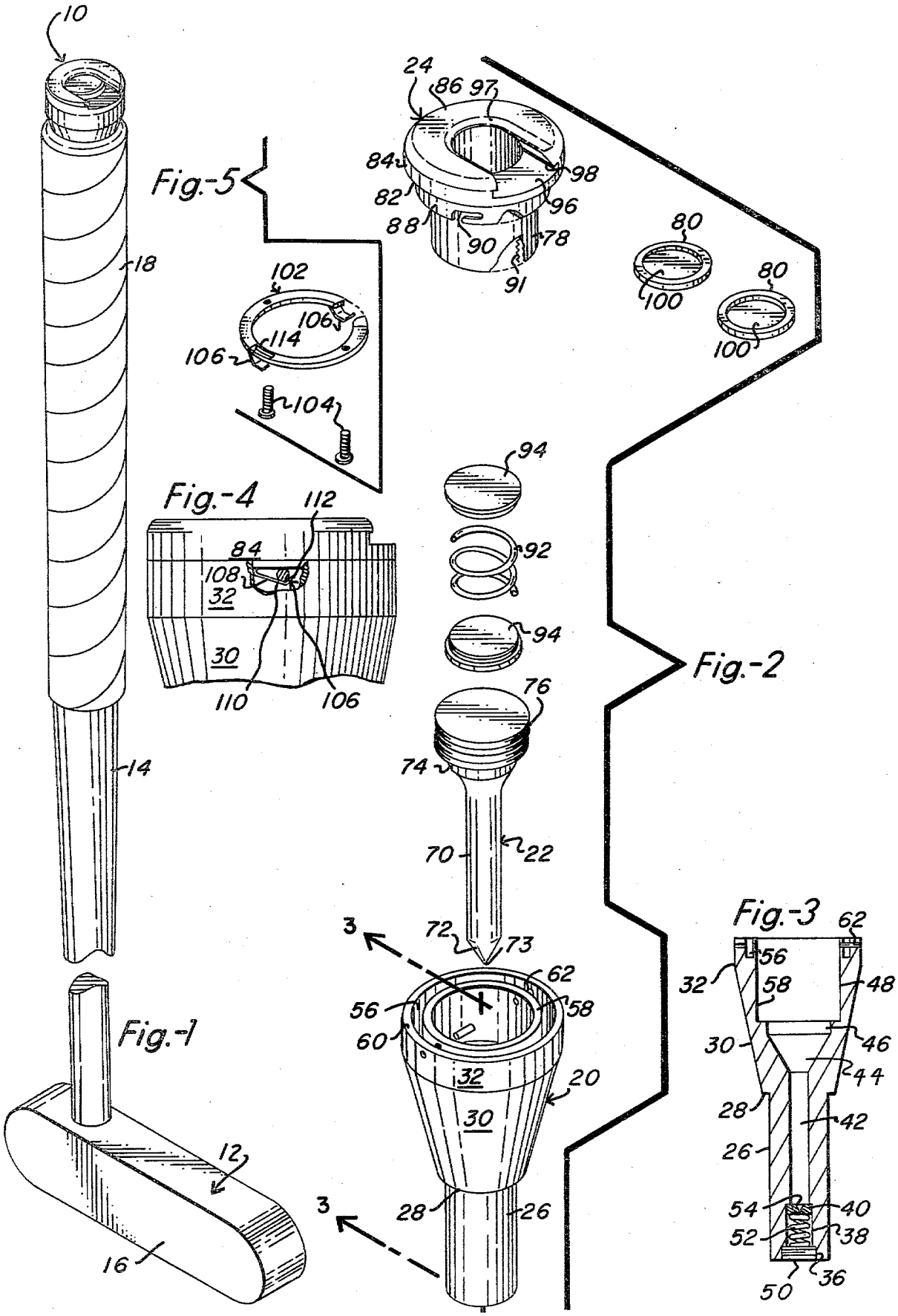
FIG. 1 is a perspective view of a putter with the invention added to its shaft.
FIG. 2 is an exploded view of the invention.
FIG. 3 is a cross sectional view of the casing, taken along the plane through line 3—3 of FIG. 2 perpendicular to the arrows.
FIG. 4 is a side elevational view of the top-most portion of the invention, with part of the casing broken away to show a modification.
FIG. 5 is an exploded view of the modification of FIG. 4.

The invention in its best form is illustrated in FIG. 1 to include the golfer's aid 10 incorporated into the top end of a golf club 12, preferrably a putter. The construction of such a club may include a shaft 14 extending upwardly from the club head 16 and having a wrap of cushioning material 18 on the upper end of the shaft. In most present day clubs, the shaft is of hollow metal tubular construction, although other types of construction would present little barrier to the use of the invention, which as presently constituted anticipates that a casing for the aid 10 will telescope into the top end of the shaft 14, and that the wrap 18 will then be applied to cover the shaft and some portions of the casing. With reference now to FIG. 2, the major parts of the invention are the casing 20, fluffing tool 22, and ball marker carrier 24.

The casing has a cylindrical lower end 26 having, for example, an outer diameter of one-half inch and an axial height of one and one-half inches, terminating at its upper end with lip 28 having suitable width to engage the top end of shaft 14 and thereby limit the degree to which the casing can be inserted into the shaft. Immediately above the lip at mid section 30, the casing flares radially ouwardly and axially upwardly, for example at thirteen degrees to the vertical axis of the casing and for an axial height of 1.125 inches, whereupon the casing again becomes a vertical cylinder at section 32, this time having an outer diameter of 1.125 inches and an axial height of 0.218 inches.

The inner construction of the casing is best understood by reference to item 20 of FIG. 2 in combination with FIG. 3. An axial bore extends through the entire casing and has a varying diameter. At the immediate bottom, the bore has a 5/16 inch diameter thread 36 cut for ⅛ inch height, followed by a 9/32 inch bore 38 continuing upwardly to a cumulative height of one-half inch, terminating in a downward facing lip 40. The bore section 42 then continues upwardly at a reduced diameter of, for example 0.250 inches to a cumulative height of one and one-half inches, after which the bore flares radially outwardly and axially upwardly in section 44 at an angle of, for example, twenty degrees to the axis and for an axial height of 0.438 inches. At the top of flared section 44, the bore becomes cylindrical at 46 with a diameter of one-half inch for a height of 0.187 inch, and then is expanded to a wider cylindrical bore 48 having a diameter of three-quarters inch and an axial height of 0.718 inch.

At the bottom of the axial bore, a threaded plug 50 mates with thread 36 and applies pressure against coil spring 52, which in turn is tensioned against pressure disc 54. The latter disc abutts lip 40 and may have a diameter of 9/32 inch, corresponding to the diameter of the bore at 38. In its upward facing surface, the disc may have a conical recess with downward pointing apex. The recess may have a top opening ⅛ inch diameter and an included angle of 60 degrees at the apex. The disc itself has a thickness of 1/16 inch in the topmost portion abutting the lip 40, and has centrally aligned depending stub with 1/18 inch diameter and 1/16 inch height, adapted to be engaged within the coil of spring 52. The disc is thus spring loaded against lip 40, but may be depressed below the lip by sufficient force.

At the top end of casing 20, an annular groove 56 is separated from the main bore of the casing by annular rib 58. The inner diameter of the rib 58 is defined by bore 48, while the outer diameter of the rib, and correspondingly the inner diameter of the groove, have a common dimension, such as 0.806 inch. The outer diameter of the groove may then be 0.956 inch, and is defined by an outer annular rib 60 forming cylindrical surface 32 on its outer side. A pair of dimeterically aligned 0.062 inch diameter pins 62 pass through ribs 58 and 60 as well as across groove 56, through apertures 62, centered, for example, at 0.075 inch below the tops of the ribs.

In the form described, the casing 20 will then be understood to have a lower protrusion 26 for engagement in a golf club shaft, and an upper housing having frusto conical outer shape and terminating in an upper end with a groove crossed by opposed pins. The inner lower end of the casing has a resiliently held, downwardly deflectable disc axially in alignment with the central bore of the housing.

With reference again to FIG. 2, the fluffing tool may include as an integral structure an elongated shaft 70 having at its lower end a tapered surface 72 leading to a point 73, the included angle of the taper being approximately 60 degrees, which corresponds to the angle of the recess in disc 54. Shaft 70 may broaden in diameter in the upward direction until becoming uniform at cylindrical surface 74, having a diameter of, for example, one-half inch. The shaft 70 may have a height of 1½ inches, plus an additional 0.125 inch for the height of surface 74, above which the tool 22 broadens to a diameter of 11/16 inch with a threaded circumferential surface 76, having an axial height of approximately 0.187 inch.

The specific tool for repairing dents in the green is configured to resemble a golf tee and is adapted to mate with the ball marker carrier in a cooperative relationship. The marker carrier includes cylindrical housing 78 for retaining and dispensing the marker tokens 80, in addition to attaching to tool 22. Housing 78 preferably is sized to fit closely into casing 20 and therefore may have an outer diameter and axial height of 0.750 inch. At the top of housing 78, carrier 24 has a downwardly facing lip 82 extending radially outwardly to a diameter similar to the maximum diameter of the casing, for example 1.125 inch, after which outer circumferential wall 84 extends upwardly for a distance such as 0.187 inch to top wall 86. Lip 82 is connected to depending skirt 88, which is configured to enter groove 56 in casing 20. The skirt is circumferentially spaced from housing 78 by the approximate thickness of rib 58, while the radial distance between the outer surface of the skirt and wall 84 is approximately similar to the thickness of rib 60. On diametrically opposite sides of skirt 88 are formed L-shaped slots 90 of suitable size to receive pins 62.

The interior circumferential surface 91 of housing 78 is threaded at the lower end and adapted to engage the threads 76 on tool 22 for the height of the threads 76. Above this point, the interior of the housing is preferably smooth and extends upwardly to within a small distance, such as 0.062 inch, of top wall 86. Within the housing fits a coil spring 92 and a pair of oppositely oriented pressure plates 94, one on each end of the spring. Each plate has a first portion of greater diameter, such as 0.615 inch, and a smaller coaxially aligned portion of second diameter, such as one-half inch. The first portion may be relatively thin, for example 1/32 inch, while the second portion may be twice as thick and is intended to be engaged inside the diameter of the spring.

The wall 84 is interrupted by a radial slot 96 of dual width. The first and narrower slot width 97, which may be one-half inch, extends from and through top wall 86 for a depth of 0.062 inch, which is the distance between top wall 86 and the previously identified interior of the housing, and is adjacent to the second slot width 98 immediately therebelow, which may have a depth of 0.062 inch and a width of 0.625 inch. The purpose of the slot 96 is to permit the ball marker tokens 80 to be removed from or inserted into the housing 78. Each token 80 is narrower in diameter than the second slot and wider than the first slot; for example, each token may be 0.620 inch in diameter and may have a thickness of 0.062 inch. For the dual purposes of providing a finger grip and providing a location in which an advertisement may be placed, each token has a recess 100 on its upper side, which recess may be 0.032 inch in depth and one-half inch in diameter. The tokens will then be understood to pass freely through slot 96 in the radial direction while slot portion 97 prevents the token from exiting the slot in the axial direction.

As will now be understood, the aid 10 is assembled by placing the pressure plates 94 on opposite sides of the spring 92 and placing these three elements into housing 78 with one plate being placed against the top of the housing interior wall. The fluffing tool 22 is then placed against the opposite plate 94 and threaded portion 76 is engaged with the threads of the housing 78, placing the spring under tension and causing the upper plate 94 to be resiliently pushed against the top of the housing. Each marker token may be placed in the slot 96 and moved into the housing while the upper plate 94 is being depressed.

The housing and tool 22 when assembled may be placed in casing 20 by matching the openings of the L-shaped slots 90 with pins 62, pressing the housing downwardly to both depress disc 54 via shaft 70 and to move the pins into the slots 90, and twisting carrier 24 to engage the pins in the circumferentially extending portions of the slots. The aid may be opened by twisting carrier 24 in the opposite direction, such as counterclockwise, and allowing carrier 24 to be raised from the casing by the action of spring 52 and disc 54 on the top of shaft 70.

FIGS. 4 and 5 show an alternative construction of carrier 24, wherein the skirt 88 is replaced by ring 102, which may be attached to lip 82 by suitable fasteners 104. At diametrically opposite sides of ring 102 are a pair of spring clips 106, which may be formed from the material of the ring by punching or like operation. A first portion 108 of each clip angles downwardly from the plane of the ring, for example at 30 degrees below horizontal, and a second portin 110 then angles upwardly, for example at 10 degrees, for a short distance, leaving an entry space between the tip 112 of the clip and the bottom of the ring for receiving a pin 62. In the case of a clip punched from the ring, an arcuate slot 114 covering approximately 55 degrees is formed above each clip. The material removed from the first 30 degrees of arc forms the first clip portion, and the material removed from the next 25 degrees of arc forms the second slip portion. The clips are resilient and therefore retain the pins 62 by spring action. Accordingly, the plug 50, spring 52 and disc 54 are not necessary when the embodiment of FIGS. 4 and 5 is employed.

In use, the assembled aid 10 may be mounted at the top of a suitable golf club by removing the top plug of the shaft 14, making any necessary adjustments in the shaft diameter, and then inserting the lower end of the casing into the shaft. The proper fit between the tool and the club shaft might be created in a number of ways. If the end 26 is larger than the shaft opening, the shaft opening could be stretched by a suitable punch, or the end 26 could be slightly reduced in size. If the shaft opening is too large, a sleeve may be added to fill the gap. After the tool has been mounted on the club, the handle wrap 18 is applied to cover both the club handle and the exposed sides of the casing below side 32.

A golfer having the aid mounting on the putter is then in constant possession of both ball markers and green repairing tool simply by virture of having his putter in hand. In the typical play of a hole after the ball has landed on the green, the golfer will leave his bag at a distance to the side of the green and enter the green with only the putter. Upon discovering the dent created by the ball's landing on the green, the golfer will remove the tool and carrier in the manner previously described and employ shaft 70 to fluff the dented area. If at this time it is evident that the golfer's ball should be marked and removed in accordance with the customs of the game, the marker carrier 24 is already in hand and a token 80 may be immediately dispensed. It should be noted that the presence of the carrier 24 in combination with tool 22 is beneficial in providing a substantial grip for the tool during the dent repairing process.

I claim:

1. A golfer's aid comprising:

(a) a casing having a central axial bore and a lower end adapted to be received in the shaft of a golf club, the upper end of said casing having an annular groove encircling said central axial bore;

(b) an elongated symmetrical tool nestable within the bore of said casing for storage and removable therefrom for repairing dents in the green;

(c) a token carrier connected to said tool and providing a handle grip thereon, and connected to an annular skirt symmetrically spaced from the elongated tool and adapted to enter said groove; and (d) means for latching said tool in the casing.

2. The golfer's aid of claim 1, wherein said elongated tool nests to a predetermined maximum depth in said casing bore, and the casing further comprises a plug closing the bore at the lower end of the casing, resilient means carried in the bore above the plug, and a pressure disc carried in the casing above the spring, and wherein the casing bore narrows to a diameter smaller than the pressure disc at a depth less than said predetermined depth for limiting the upward travel of the disc when the elongated tool is not in the casing.

3. The golfer's aid of claim 2, wherein said tool further comprises a tapered end portion that contacts said disc; and disc further comprises a top surface having a central recess formed therein with a contour adapted to receive said tapered end portion of the tool, and a depending stub adapted to engage and spring.

4. The golfer's aid of claim 1, wherein said latching means comprises:

(a) said annular groove symmetrically encircling the upper end of said bore;

(b) radially extending pin means crossing said groove and;

(c) clip means associated with said skirt for engaging the pin means to retain the tool in the casing.

5. The golfer's aid of claim 1, wherein said elongated tool is symmetrical about its longitudinal axis throughout the lower portion of the tool for guiding, in cooperation with said central axial bore, said skirt into said groove and further comprises first detachable engaging means on the upper end thereof for connection to the lower end of said token carrier; and wherein the carrier further comprises second detachable engaging means on the lower end thereof for mating connection with said first detachable engaging means.

6. The golfer's aid of claim 1, wherein said carrier is of the type having a spring loaded pressure plate holding tokens against the top of the carrier, and having a laterally extending slot adjacent to the top of the carrier for hand removal of token therethrough, further comprising an improved token having top and bottom circular surfaces, the top surface having a circular recess therein for receiving an informational insert and for providing a finger grip to aid removal from the carrier.

7. The golfer's aid of claim 1, wherein said carrier is of the type having a spring loaded pressure plate holding tokens against the top of the carrier and having the bottom of the carrier receive the counter pressure of the spring, and wherein the bottom of the carrier comprises the top of said elongated tool, and said tool is removably attached to the carrier by a threaded connection.

* * * * *